US011344088B1

(12) United States Patent
Bowens

(10) Patent No.: US 11,344,088 B1
(45) Date of Patent: May 31, 2022

(54) WALKING CANE SUSPENSION ASSEMBLY

(71) Applicant: Roy Bowens, Akron, OH (US)

(72) Inventor: Roy Bowens, Akron, OH (US)

( * ) Notice: Subject to any disclaimer, the term of this patent is extended or adjusted under 35 U.S.C. 154(b) by 0 days.

(21) Appl. No.: 17/124,559

(22) Filed: Dec. 17, 2020

(51) Int. Cl.
*A45B 1/04* (2006.01)

(52) U.S. Cl.
CPC ..... *A45B 1/04* (2013.01)

(58) Field of Classification Search
CPC ..... A45B 1/044; A45B 1/04
See application file for complete search history.

(56) References Cited

U.S. PATENT DOCUMENTS 1,068,273 A * 7/1913 Reed ..... A47F 5/0006 248/691
1,758,379 A 5/1930 Shaw
4,300,742 A * 11/1981 Hunn ..... A47G 25/12 248/229.26
4,895,330 A * 1/1990 Anstead ..... A45B 1/04 248/229.12
5,000,418 A 3/1991 Vogt
5,456,437 A * 10/1995 Chander ..... A45B 1/04 211/62
6,502,283 B1 1/2003 Aguirre
7,422,188 B1 * 9/2008 Schlosser ..... A45B 1/04 224/407
7,992,583 B2 * 8/2011 Lisenby ..... A45B 9/00 135/66
10,470,536 B1 * 11/2019 Lundaas ..... A45B 3/00
2005/0035251 A1 2/2005 Wallin
2009/0145470 A1 6/2009 Couper

FOREIGN PATENT DOCUMENTS

CA 2436994 2/2005

* cited by examiner

*Primary Examiner* — Noah Chandler Hawk

(57) ABSTRACT

A walking cane suspension assembly includes a walking cane that can support a user while the user is walking. A sleeve is provided and the sleeve is comprised of a first half which is pivotally coupled to a second half. The sleeve is closeable around the walking cane and the sleeve is openable to facilitate the sleeve to be removed from the walking cane. A grapple is pivotally coupled to the sleeve and the grapple is positionable in a deployed position having the grapple extending outwardly from the sleeve. In this way the grapple can engage a support for suspending the walking cane from the support for storage. Additionally, the grapple is positionable in a stored position having the grapple lying against the sleeve.

12 Claims, 6 Drawing Sheets

WALKING CANE SUSPENSION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to suspension devices and more particularly pertains to a new suspension device for suspending a walking cane for storage. The suspension device can be employed on any walking cane that has a tubular cross section. Additionally, the suspension device facilitates a walking cane to be stored without tipping over.

(2) Description of Related Art Including Information Disclosed Under 37 CFR 1.97 and 1.98

The prior art relates to suspension devices including a walking cane that has a pair of hooks being movably integrated therein to hang the walking cane for storage. The prior art discloses a biased clip that can be coupled to a walking cane thereby facilitating the biased clip to engage a support for storing the walking cane. The prior art also discloses a variety of clamping mechanisms that can be integrated into a walking cane for clamping a support to store the walking cane.

BRIEF SUMMARY OF THE INVENTION

An embodiment of the disclosure meets the needs presented above by generally comprising a walking cane that can support a user while the user is walking. A sleeve is provided and the sleeve is comprised of a first half which is pivotally coupled to a second half. The sleeve is closeable around the walking cane and the sleeve is openable to facilitate the sleeve to be removed from the walking cane. A grapple is pivotally coupled to the sleeve and the grapple is positionable in a deployed position having the grapple extending outwardly from the sleeve. In this way the grapple can engage a support for suspending the walking cane from the support for storage. Additionally, the grapple is positionable in a stored position having the grapple lying against the sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
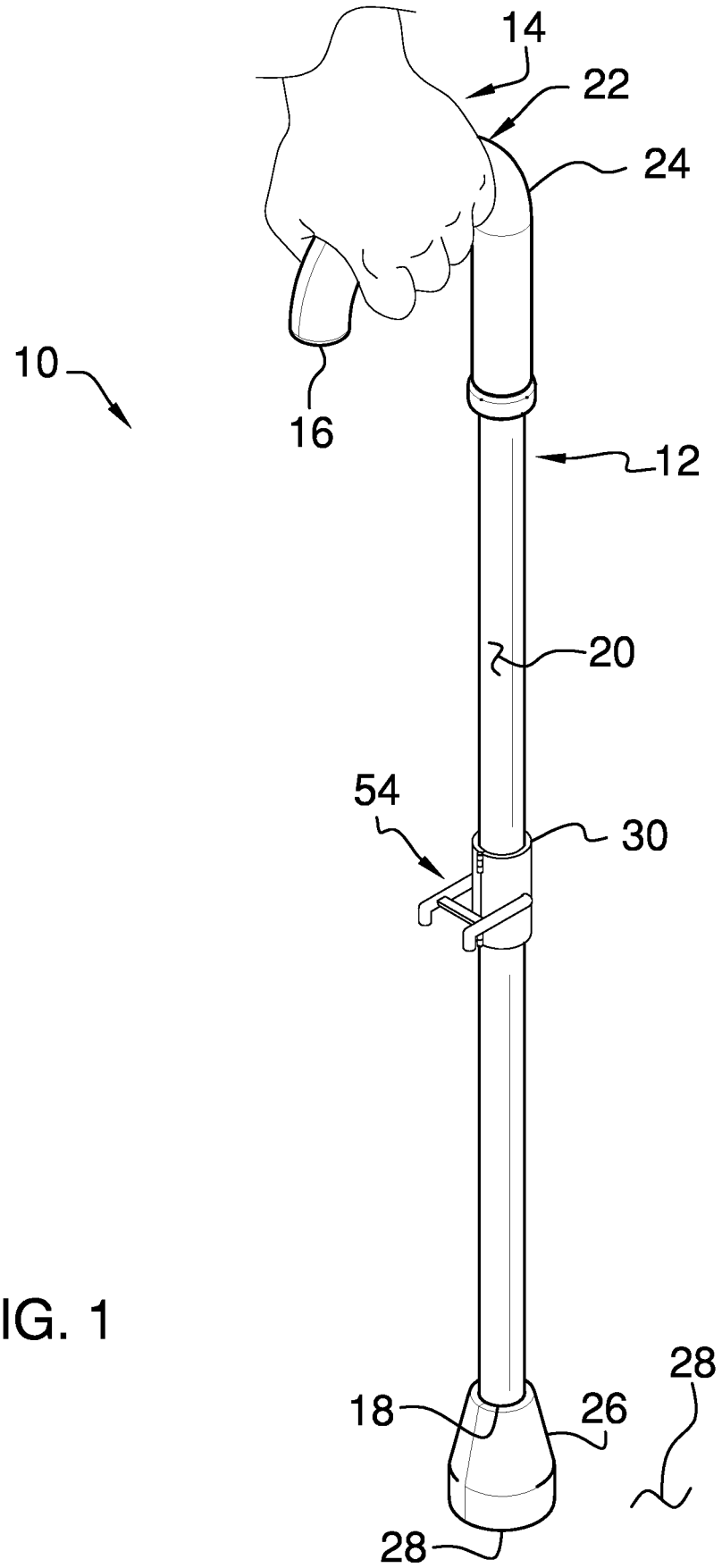
FIG. 1 is a perspective view of a walking cane suspension assembly according to an embodiment of the disclosure.
Figure 2:
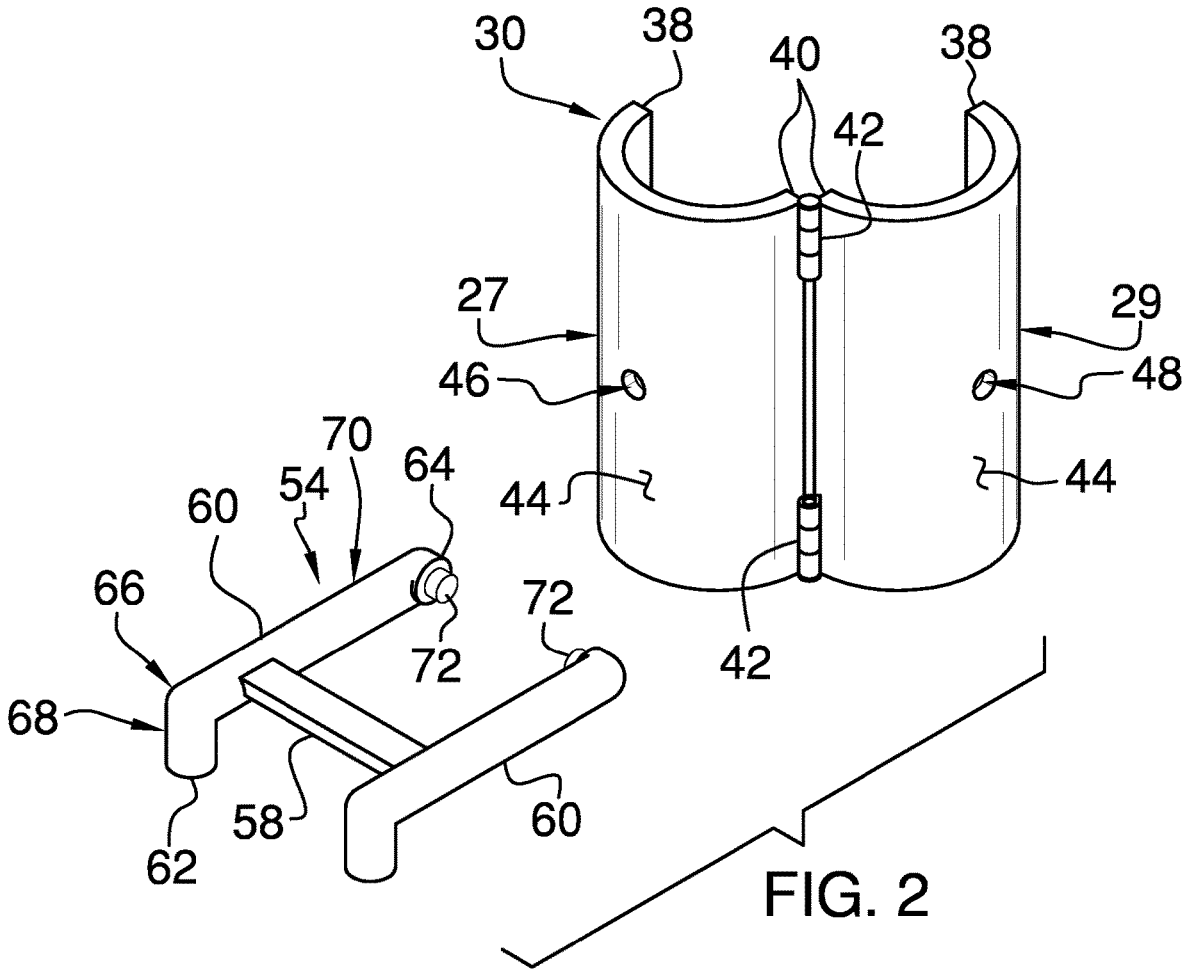
FIG. 2 is an exploded view of a sleeve and a grapple of an embodiment of the disclosure.
Figure 3:
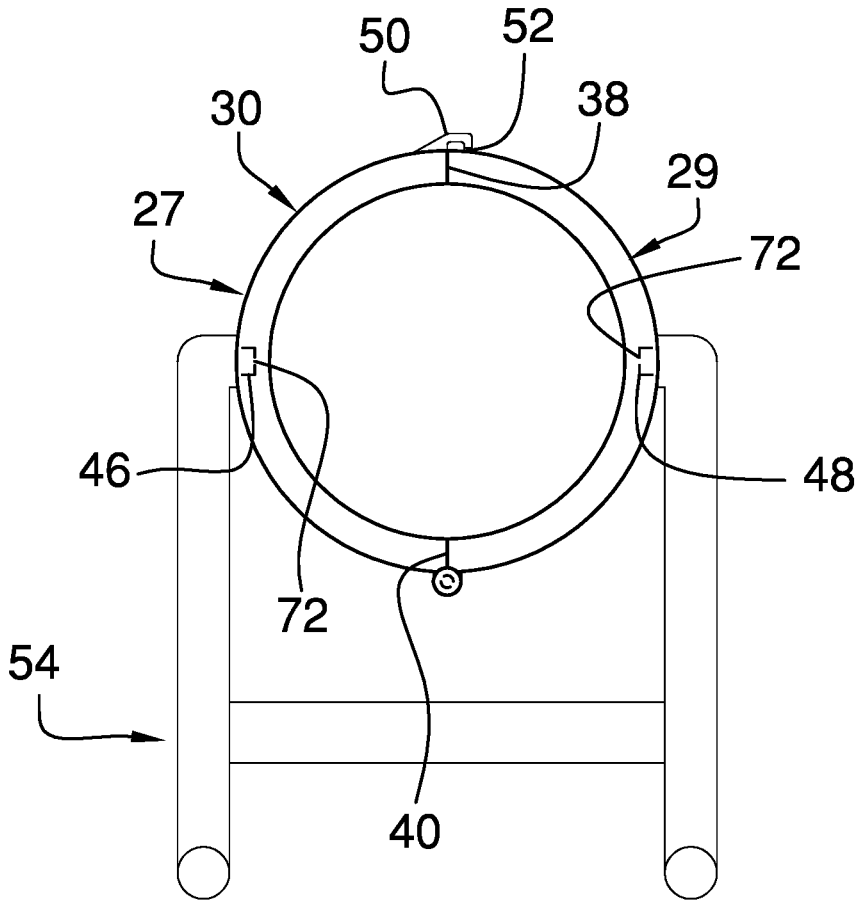
FIG. 3 is a top view of a sleeve and a grapple of an embodiment of the disclosure.
Figure 4:
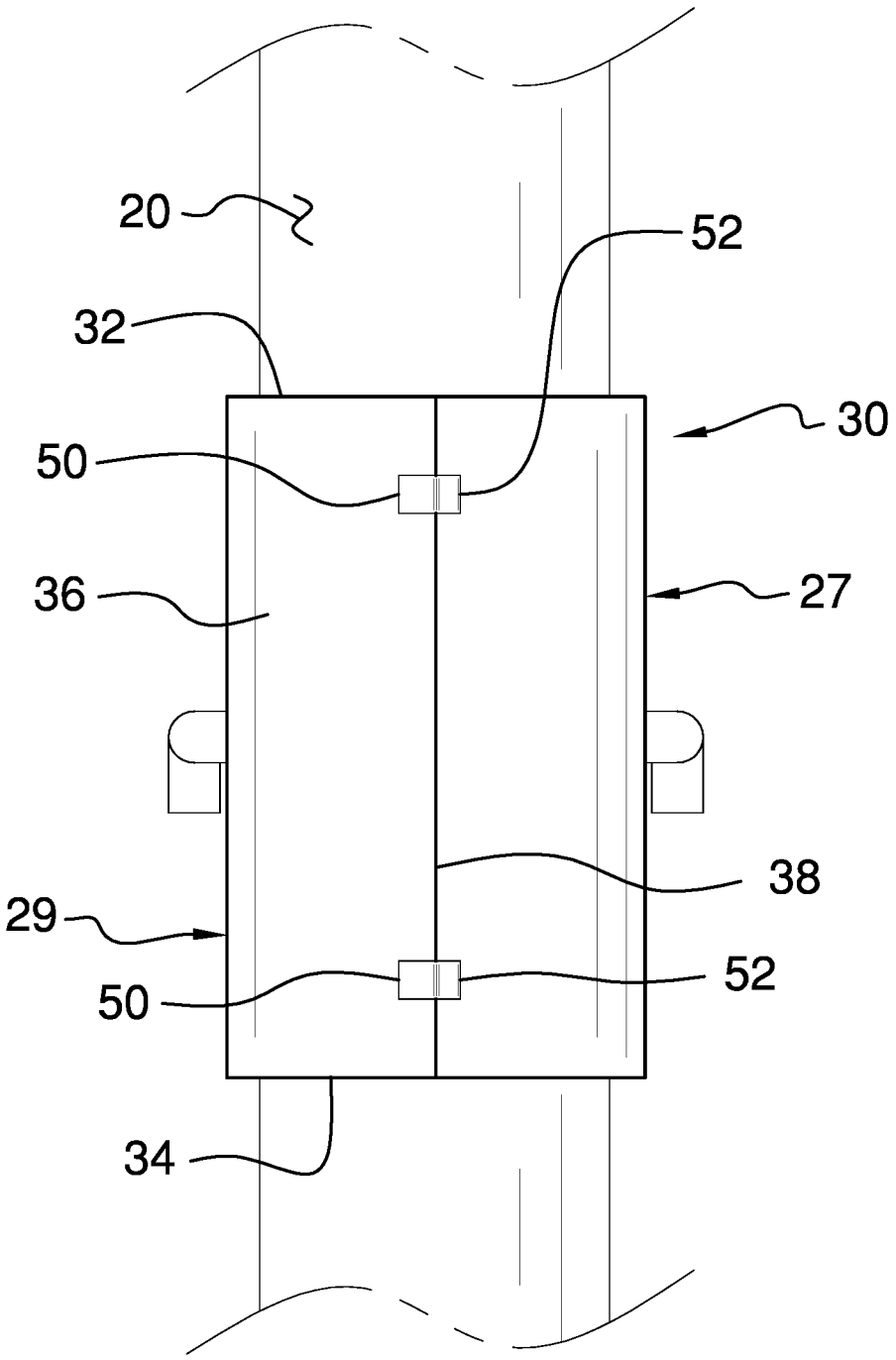
FIG. 4 is a back view of an embodiment of the disclosure.
Figure 5:
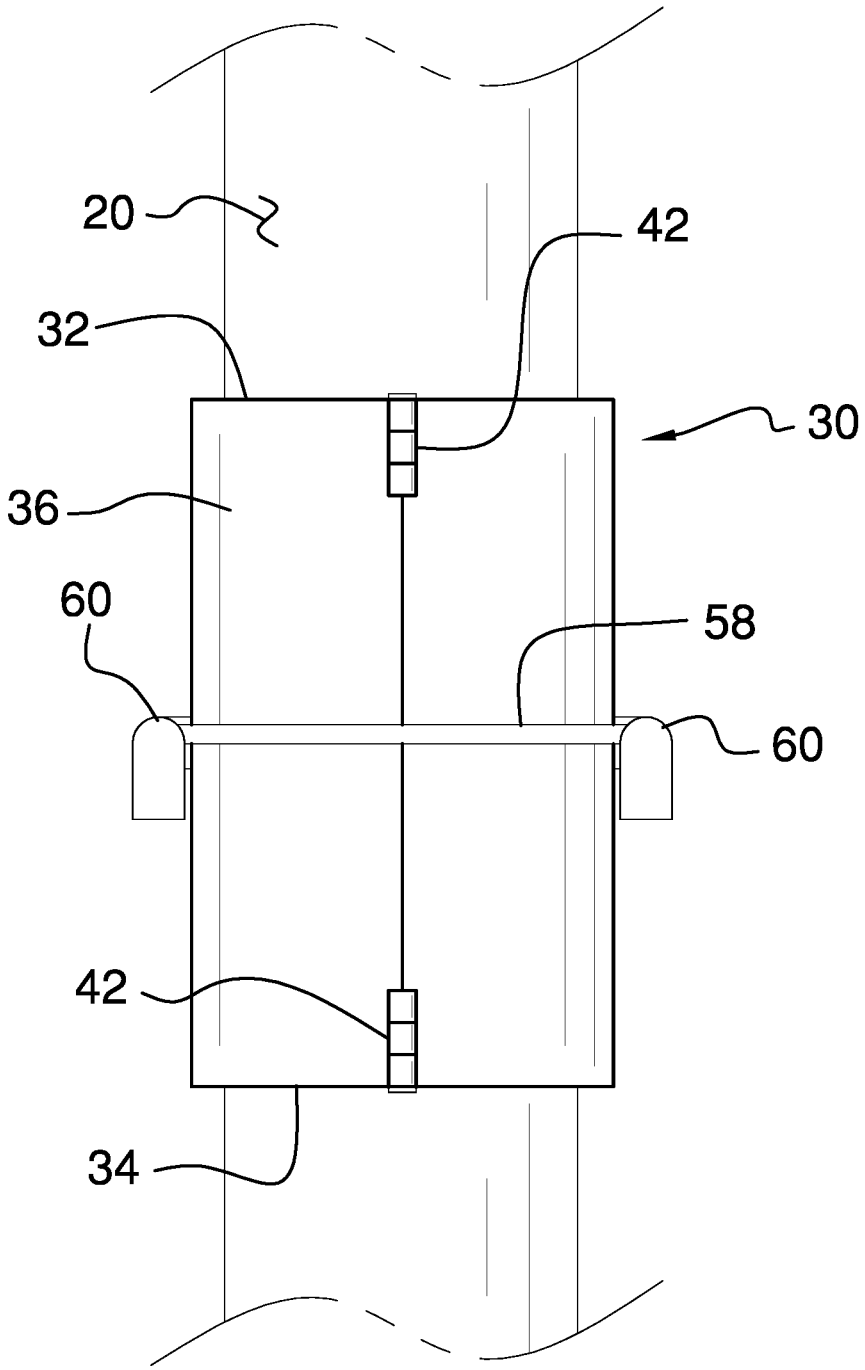
FIG. 5 is a front view of an embodiment of the disclosure.
Figure 6:
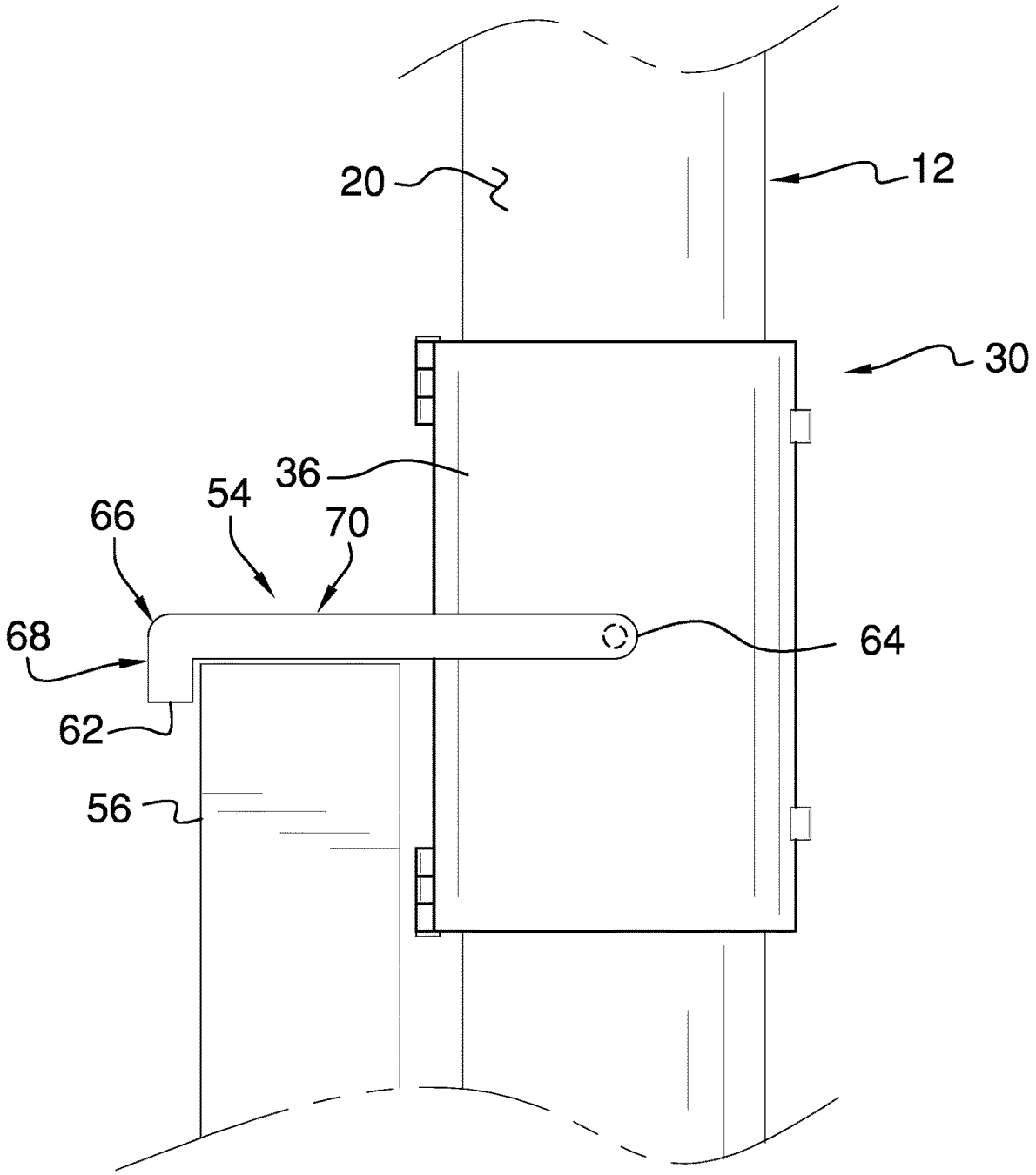
FIG. 6 is a left side in-use view of an embodiment of the disclosure.

With reference now to the drawings, and in particular to FIGS. 1 through 6 thereof, a new suspension device embodying the principles and concepts of an embodiment of the disclosure and generally designated by the reference numeral 10 will be described.

As best illustrated in FIGS. 1 through 6, the walking cane suspension assembly 10 generally comprises a walking cane 12 that can support a user 14 while the user 14 is walking. The walking cane 12 has a first end 16, a second end 18 and an outer surface 20 extending therebetween. Additionally, the walking cane 12 has a curved portion 22 that is positioned adjacent to the first end 16 such that the first end 16 is directed toward the second end 18. Thus, the walking cane 12 has a J-shape thereby facilitating the curved portion 22 to be gripped by the user 14. A cushion 24 is positioned around the walking cane 12 for gripping by the user 14. The cushion 24 extends around the outer surface 20 of the walking cane 12 and the cushion 24 extends from the first end 16 toward the second end 18 having the cushion 24 extending around the curved portion 22. Moreover, the cushion 24 is comprised of a resiliently compressible material, including but not being limited to rubber or silicone, to enhance comfort for the user 14.

A foot 26 is coupled to the walking cane 12 such that the foot 26 abuts a support surface 28 upon which the user 14 is walking. The foot 26 is positioned on the second end 18 of the walking cane 12 and the foot 26 has a distal end 28. Additionally, the foot 26 flares outwardly between the second end 18 of the walking cane 12 and the distal end 28 to enhance stability of the walking cane 12. The foot 26 may be comprised of a resiliently compressible material, including but not being limited to, rubber or silicone, to enhance comfort for the user 14 as well as enhancing the foot's 26 ability to grip the support surface 28.

A sleeve 30 is provided and the sleeve 30 is comprised of a first half 27 that is pivotally coupled to a second half 29. In this way the sleeve 30 is closeable around the walking cane 12 and the sleeve 30 is openable to facilitate the sleeve 30 to be removed from the walking cane 12. The sleeve 30 has an upper end 32, a lower end 34 and an outer wall 36 extending therebetween. The outer wall 36 has a first cut 38 extending between the upper end 32 and the lower end 34 and the outer wall 36 has a second cut 40 extending between the upper end 32 and the lower end 34. Moreover, the second cut 40 is positioned on an opposite side of the outer wall 36 from the first cut 38 such that each of the first cut 38 and the second cut 40 defines the first half 27 and the second half 29 of the sleeve 30.

The first half 27 is pivotally coupled to the second half 29 at a plurality of pivot points 42 that are distributed along the second cut 40. An outer surface 44 of the outer wall 36 of the first half 27 has a first well 46 extending therein and the first well 46 is centrally positioned between the upper end 32 and the lower end 34. The outer surface 44 of the outer wall 36 of the second half 29 has a second well 48 extending therein and the second well 48 is aligned with the first well 46. The outer surface 44 of the outer wall 36 of the first half 27 has an engagement 50 coupled thereto, and the engagement 50 extends across the first cut 38 when the sleeve 30 is closed around the walking cane 12. The outer surface 20 of the outer wall 36 of the second half 29 has an engagement point 52 integrated therein. The engagement 50 releasably engages the engagement point 52 when the sleeve 30 is closed around the walking cane 12 for retaining the sleeve 30 around the walking cane 12. The engagement 50 may comprise a finger with a ridge and the engagement point 52 may comprise a recess to receive the ridge on the finger. Additionally, the sleeve 30 can be positioned around any walking cane that has a tubular cross section.

A grapple 54 is provided and the grapple 54 is pivotally coupled to the sleeve 30. The grapple 54 is positionable in a deployed position having the grapple 54 extending outwardly from the sleeve 30. In this way the grapple 54 can engage a support 56 to suspend the walking cane 12 from the support 56 for storage. Additionally, the grapple 54 is positionable in a stored position having the grapple 54 lying against the sleeve 30. The grapple 54 comprises a central member 58 extending between a pair of outward members 60. Each of the outward members 60 is oriented to extend along a parallel axis with respect to each other, and each of the outward members 60 has a first end 62 and a second end 64.

Each of the outward members 60 has a bend 66 thereon that is positioned closer to the first end 62 than the second end 64 to define a first section 68 of the outward members 60 that is oriented perpendicular to a second section 70 of the outward members 60. The central member 58 is positioned closer to the bend 66 on the outward members 60 than the second end 64 of the outward members 60. Additionally, each of the outward members 60 has a tab 72 extending laterally away therefrom such that the tab 72 on each of the outward members 60 is directed toward each other. The tab 72 on each of the outward members 60 is positioned adjacent to the second end 64 of the outward members 60. The tab 72 on each of the outward members 60 engages a respective one of the first well 46 and the second well 48 in the outer surface 44 of the outer wall 36 of the sleeve 30 for pivotally retaining the grapple 54 to the sleeve 30.

The second section 70 of each of the outward members 60 is oriented to extend along a perpendicular axis with respect to a longitudinal axis of the walking cane 12 when the grapple 54 is positioned in the deployed position. In this way the second section 70 of each of the outward members 60 can rest on the support 56. The first section 68 of each of the outward members 60 extends toward the second end 18 of the walking cane 12 when the grapple 54 is positioned in the deployed position. In this way the first section 68 of each of the outward members 60 inhibits the second section 70 of each of the outward members 60 from sliding off of the support 56. The second section 70 of each of the outward members 60 extends downwardly toward the second end 18 of the walking cane 12 when the grapple 54 is positioned in the stored position.

In use, the walking cane 12 is employed in the traditional convention of walking canes. The grapple 54 is positioned in the deployed position to facilitate the walking cane 12 to be suspended form a support 56 for storage. In this way the walking cane 12 can be stored without tipping over. The walking cane 12 is removed from the support 56 and the grapple 54 is positioned in the stored position when the user 14 wishes to employ the walking cane 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A walking cane suspension assembly for suspending a walking cane from a support for storage, said assembly comprising:

a walking cane being configured to support a user while the user is walking, wherein said walking cane has a first end, a second end and an outer surface extending therebetween, said walking cane having a curved portion being positioned adjacent to said first end such that said first end is directed toward said second end thereby facilitating said walking cane to have a J-shape wherein said curved portion is configured to be gripped by the user;

a cushion being positioned around said walking cane wherein said cushion is configured to be gripped by the user, said cushion extending around said outer surface of said walking cane, said cushion extending from said first end toward said second end having said cushion extending around said curved portion, said cushion being comprised of a resiliently compressible material wherein said cushion is configured to enhance comfort for the user;

a foot being coupled to said walking cane wherein said foot is configured to abut a support surface;

a sleeve being comprised of a first half being pivotally coupled to a second half, said sleeve being closeable around said walking cane, said sleeve being openable to facilitate said sleeve to be removed from said walking cane; and a grapple being pivotally coupled to said sleeve, said grapple being positionable in a deployed position having said grapple extending outwardly from said sleeve wherein said grapple is configured to engage a support for suspending said walking cane from said support for storage, said grapple being positionable in a stored position having said grapple lying against said sleeve;

wherein said sleeve has an upper end, a lower end and an outer wall extending therebetween, said outer wall having a first cut extending between said upper end and said lower end, said outer wall having a second cut extending between said upper end and said lower end, said second cut being positioned on an opposite side of said outer wall from said first cut such that each of said first cut and said second cut defines said first half and said second half of said sleeve, said first half being pivotally coupled to said second half at a plurality of pivot points along said second cut; and wherein an outer surface of said outer wall of said first half has a first well extending therein, said first well being centrally positioned between said upper end and said lower end.

2. The assembly according to claim 1, wherein said foot is positioned on said second end of said walking cane, said foot having a distal end, said foot flaring outwardly between said second end of said cane and said distal end wherein said distal end is configured to enhance stability of said walking cane.

3. The assembly according to claim 1, wherein said outer surface of said outer wall of said second half has a second well extending therein, said second well being aligned with said first well.

4. The assembly according to claim 1, wherein an outer surface of said outer wall of said first half has an engagement being coupled thereto, said engagement extending across said first cut when said sleeve is closed around said walking cane.

5. The assembly according to claim 4, wherein said outer surface of said outer wall of said second half has an engagement point being integrated therein, said engagement releasably engaging said engagement point when said sleeve is closed around said walking cane for retaining said sleeve around said walking cane.

6. The assembly according to claim 1, wherein said grapple comprises a central member extending between a pair of outward members, each of said outward members being oriented to extend along a parallel axis with respect to each other.

7. The assembly according to claim 6, wherein each of said outward members has a first end and a second end, each of said outward members having a bend thereon being positioned closer to said first end than said second end to define a first section of said outward members being oriented perpendicular to a second section of said outward members, said central member being positioned closer to said bend on said outward members than said second end of said outward members.

8. The assembly according to claim 7, wherein said second section of each of said outward members is oriented to extend along a perpendicular axis with respect to a longitudinal axis of said walking cane when said grapple is positioned in said deployed position wherein said second section of each of said outward members is configured to rest on the support.

9. The assembly according to claim 8, wherein said first section of each of said outward members extends toward said second end of said walking cane when said grapple is positioned in said deployed position wherein said first section of each of said outward members is configured to inhibit said second section of each of said outward members from sliding off of the support.

10. The assembly according to claim 7, wherein said second section of each of said outward members extending downwardly toward said second end of said walking cane when said grapple is positioned in said stored position.

11. A walking cane suspension assembly for suspending a walking cane from a support for storage, said assembly comprising:

a walking cane being configured to support a user while the user is walking, wherein said walking cane has a first end, a second end and an outer surface extending therebetween, said walking cane having a curved portion being positioned adjacent to said first end such that said first end is directed toward said second end thereby facilitating said walking cane to have a J-shape wherein said curved portion is configured to be gripped by the user;

a cushion being positioned around said walking cane wherein said cushion is configured to be gripped by the user, said cushion extending around said outer surface of said walking cane, said cushion extending from said first end toward said second end having said cushion extending around said curved portion, said cushion being comprised of a resiliently compressible material wherein said cushion is configured to enhance comfort for the user;

a foot being coupled to said walking cane wherein said foot is configured to abut a support surface;

a sleeve being comprised of a first half being pivotally coupled to a second half, said sleeve being closeable around said walking cane, said sleeve being openable to facilitate said sleeve to be removed from said walking cane;

a grapple being pivotally coupled to said sleeve, said grapple being positionable in a deployed position having said grapple extending outwardly from said sleeve wherein said grapple is configured to engage a support for suspending said walking cane from said support for storage, said grapple being positionable in a stored position having said grapple lying against said sleeve;

wherein said grapple comprises a central member extending between a pair of outward members, each of said outward members being oriented to extend along a parallel axis with respect to each other;

wherein each of said outward members has a first end and a second end, each of said outward members having a bend thereon being positioned closer to said first end than said second end to define a first section of said outward members being oriented perpendicular to a second section of said outward members, said central member being positioned closer to said bend on said outward members than said second end of said outward members;

wherein an outer surface of an outer wall of said first half of said sleeve has a first well extending therein, said first well being centrally positioned between said upper end and said lower end;

wherein said outer surface of said outer wall of said second half of said sleeve has a second well extending therein, said second well being aligned with said first well; and wherein each of said outward members has a tab extending laterally away therefrom such that said tab on each of said outward members is directed toward each other, said tab on each of said outward members being positioned adjacent to said second end, said tab on each of said outward members engaging a respective one of said first well and said second well in said outer surface of said outer wall of said sleeve for pivotally retaining said grapple to said sleeve.

12. A walking cane suspension assembly for suspending a walking cane from a support for storage, said assembly comprising:

a walking cane being configured to support a user while the user is walking, said walking cane having a first end, a second end and an outer surface extending therebetween, said walking cane having a curved portion being positioned adjacent to said first end such that said first end is directed toward said second end thereby facilitating said walking cane to have a J-shape wherein said curved portion is configured to be gripped by the user;

a cushion being positioned around said walking cane wherein said cushion is configured to be gripped by the user, said cushion extending around said outer surface of said walking cane, said cushion extending from said first end toward said second end having said cushion extending around said curved portion, said cushion being comprised of a resiliently compressible material wherein said cushion is configured to enhance comfort for the user;

a foot being coupled to said walking cane wherein said foot is configured to abut a support surface, said foot being positioned on said second end of said walking cane, said foot having a distal end, said foot flaring outwardly between said second end of said cane and said distal end wherein said distal end is configured to enhance stability of said walking cane;

a sleeve being comprised of a first half being pivotally coupled to a second half, said sleeve being closeable around said walking cane, said sleeve being openable to facilitate said sleeve to be removed from said walking cane, said sleeve having an upper end, a lower end and an outer wall extending therebetween, said outer wall having a first cut extending between said upper end and said lower end, said outer wall having a second cut extending between said upper end and said lower end, said second cut being positioned on an opposite side of said outer wall from said first cut such that each of said first cut and said second cut defines said first half and said second half of said sleeve, said first half being pivotally coupled to said second half at a plurality of pivot points along said second cut, an outer surface of said outer wall of said first half having a first well extending therein, said first well being centrally positioned between said upper end and said lower end, said outer surface of said outer wall of said second half having a second well extending therein, said second well being aligned with said first well, said outer surface of said outer wall of said first half having an engagement being coupled thereto, said engagement extending across said first cut when said sleeve is closed around said walking cane, said outer surface of said outer wall of said second half having an engagement point being integrated therein, said engagement releasably engaging said engagement point when said sleeve is closed around said walking cane for retaining said sleeve around said walking cane; and a grapple being pivotally coupled to said sleeve, said grapple being positionable in a deployed position having said grapple extending outwardly from said sleeve wherein said grapple is configured to engage a support for suspending said walking cane from said support for storage, said grapple being positionable in a stored position having said grapple lying against said sleeve said grapple comprising a central member extending between a pair of outward members, each of said outward members being oriented to extend along a parallel axis with respect to each other, each of said outward members having a first end and a second end, each of said outward members having a bend thereon being positioned closer to said first end than said second end to define a first section of said outward members being oriented perpendicular to a second section of said outward members, said central member being positioned closer to said bend on said outward members than said second end of said outward members, each of said outward members having a tab extending laterally away therefrom such that said tab on each of said outward members is directed toward each other, said tab on each of said outward members being positioned adjacent to said second end, said tab on each of said outward members engaging a respective one of said first well and said second well in said outer surface of said outer wall of said sleeve for pivotally retaining said grapple to said sleeve, said second section of each of said outward members being oriented to extend along a perpendicular axis with respect to a longitudinal axis of said walking cane when said grapple is positioned in said deployed position wherein said second section of each of said outward members is configured to rest on the support, said first section of each of said outward members extending toward said second end of said walking cane when said grapple is positioned in said deployed position wherein said first section of each of said outward members is configured to inhibit said second section of each of said outward members from sliding off of the support, said second section of each of said outward members extending downwardly toward said second end of said walking cane when said grapple is positioned in said stored position.

* * * * *